US009421562B2

(12) United States Patent
Krayer

(10) Patent No.: US 9,421,562 B2
(45) Date of Patent: Aug. 23, 2016

(54) PAINT-SPRAYING APPARATUS

(71) Applicant: J. WAGNER GMBH, Markdorf (DE)

(72) Inventor: Elmar Krayer, Langenargen (DE)

(73) Assignee: J. Wagner GmbH, Markdorf (DE)

( * ) Notice: Subject to any disclaimer, the term of this patent is extended or adjusted under 35 U.S.C. 154(b) by 273 days.

(21) Appl. No.: 14/067,215

(22) Filed: Oct. 30, 2013

(65) Prior Publication Data

US 2014/0077002 A1 Mar. 20, 2014

Related U.S. Application Data

(63) Continuation of application No. PCT/EP2012/001914, filed on May 4, 2012.

(30) Foreign Application Priority Data

May 6, 2011 (DE) ..... 10 2011 100 806

(51) Int. Cl.
*B05B 15/06* (2006.01)
*B05B 7/04* (2006.01)
(Continued)

(52) U.S. Cl.
CPC ..... *B05B 7/0475* (2013.01); *B05B 1/3033* (2013.01); *B05B 1/3046* (2013.01);
(Continued)

(58) Field of Classification Search
CPC ..... B05B 7/02; B05B 7/025; B05B 7/06; B05B 7/062; B05B 7/066; B05B 7/068; B05B 7/08; B05B 7/0807; B05B 7/0815; B05B 7/0823; B05B 7/083; B05B 9/01; B05B 12/002; B05B 7/04; B05B 7/0416; B05B 7/0441; B05B 7/0475; B05B 15/06; B05B 15/165; B05B 15/166; B05B 1/30; B05B 1/3033; B05B 1/304; B05B 1/3046; B05B 1/04; B05B 1/042
USPC ..... 239/299, 300, 301, 340, 408, 413, 239/416.4, 416.5, 417, 417.3, 417.5, 526, 239/597–599, 601
See application file for complete search history.

(56) References Cited

U.S. PATENT DOCUMENTS 1,583,220 A 5/1926 Anderson
8,308,083 B2 * 11/2012 Woodgate ..... B05B 1/3046 239/296

(Continued)

FOREIGN PATENT DOCUMENTS

DE 1 013 550 A 8/1957
DE 203 06 113 U1 8/2004

(Continued)

OTHER PUBLICATIONS

German Office Action, German Application No. 10 2011 100 806.7, dated Jan. 29, 2015 (5 pages).

(Continued)

*Primary Examiner* — Christopher Kim
(74) *Attorney, Agent, or Firm* — Burr & Brown, PLLC

(57) ABSTRACT

The invention relates to a paint-spraying apparatus for generating a shaped paint jet, including a paint nozzle positioned in an annular gap, wherein the paint nozzle comprises a needle with a needle head and also comprises a paint outlet opening, wherein the needle head is displaceable with respect to the paint outlet opening over a longitudinal axis of the needle in order to control a needle valve formed from the paint outlet opening and the needle head, and wherein the needle head, in a closed position of the paint nozzle, plugs in a form-fitting manner with respect to the longitudinal axis in the paint outlet opening, wherein the paint outlet opening is rotatable together with the needle head about the longitudinal axis in order to rotate the orientation of the shaped paint jet with respect to the longitudinal axis.

15 Claims, 5 Drawing Sheets

(51) Int. Cl.

| | |
|---|---|
| ***B05B 1/30*** | (2006.01) |
| ***B05B 7/02*** | (2006.01) |
| ***B05B 7/06*** | (2006.01) |
| ***B05B 7/08*** | (2006.01) |
| *B05B 1/04* | (2006.01) |

(52) U.S. Cl.

CPC ..... *B05B 7/025* (2013.01); *B05B 7/066* (2013.01); *B05B 7/0823* (2013.01); *B05B 15/066* (2013.01); *B05B 1/042* (2013.01)

(56) References Cited

U.S. PATENT DOCUMENTS

| | | | | |
|---|---|---|---|---|
| 9,073,068 | B2 * | 7/2015 | Krayer | B05B 7/025 |
| 2008/0029619 | A1 | 2/2008 | Gohring et al. | |
| 2012/0160935 | A1 | 6/2012 | Krayer et al. | |
| 2012/0261500 | A1 | 10/2012 | Krayer et al. | |

FOREIGN PATENT DOCUMENTS

| | | | |
|---|---|---|---|
| DE | 10 2009 053 449 | A1 | 2/2011 |
| DE | 10 2009 048 022 | A1 | 4/2011 |
| EP | 0 596 939 | B1 | 12/1998 |
| EP | 1 880 771 AI | | 1/2008 |
| EP | 1 964 616 | A2 | 9/2008 |
| JP | 2000-126662 | A | 5/2000 |
| WO | 2005/000583 | A1 | 1/2005 |

OTHER PUBLICATIONS

International Search Report and Written Opinion dated Jul. 26, 2012.

* cited by examiner

PAINT-SPRAYING APPARATUS

CROSS REFERENCE TO RELATED APPLICATIONS

This application is a continuation of International Application No. PCT/EP2012/001914 filed May 4, 2012, which designated the United States, and claims the benefit under 35 USC §119(a)-(d) of German Application No. 10 2011 100 806.7 filed May 6, 2011, the entireties of which are incorporated herein by reference.

BACKGROUND OF THE INVENTION

1. Field of the Invention

The invention relates to a paint-spraying apparatus for producing a shaped paint jet, and to a needle for a needle valve for a paint-spraying apparatus.

In accordance with the invention, the paint-spraying apparatus can also be used for other air-driven application methods which make use of the function according to the invention of the rotatable production of a shaped paint jet of the paint-spraying apparatus.

2. Description of Related Art

In the field of spraying application methods, for example in the case of paint spraying or lacquer spraying, there are a large number of basic technical principles. Besides what are known as airless methods, which atomize paint at high pressure and apply it to a surface, there are a large number of methods operated on the basis of compressed air. Here, a paint jet exiting from a nozzle is nebulized by means of air masses (primary atomization air) flowing past and is thus transported in the form of a paint jet mist in the direction of a working plane. The working plane arranged at a suitable working distance for a coating procedure is contacted in this way by the paint jet, and the paint is thus applied thereto. In this case, apparatuses operated on the basis of compressor compressed air and also what are known as HVLP (high volume low pressure) apparatuses inter alia are known from the prior art and differ in terms of some operating parameters, for example the nozzle air pressure, from the conventional high-pressure apparatuses.

The type of apparatus from the prior art is suitable for providing a flat paint jet, which provides advantages when applying a paint to a surface. Compared to a radially symmetrical round paint jet, a flat jet provides increased homogeneity as the paint is applied, similarly to application by means of brush or application by means of roller, whereby the result of the paint coating is considerably improved.

Paint-spraying devices, in which a radially symmetrical round paint jet, which exits from a paint nozzle, is deformed by air deflection means which are arranged to the side of the paint nozzle and are designed in the form of what are known as air horns, such that a produced flat paint jet appears in the region of a working plane, are known from the prior art, for example from EP 0 596 939 B1.

Furthermore, a spray head for producing a flat paint jet on a paint-spraying apparatus is known from DE 10 2009 053 449 A1, with which wall paint or viscous paint can also be processed well. Depending on the design of the spray head, the flat jet that can be produced has a vertical or horizontal alignment, such that it is either suitable for applying the paint optimally to vertical or horizontal wall faces. A flat paint jet in horizontal and vertical direction is used above all to allow the user to coat the surfaces vertically and horizontally in the two primary working directions (=gun movement). This is important in particular in order to carry out what is known as cross-coating, in which a surface is coated successively once in a vertical working direction and once in a horizontal working direction in order to avoid structural shadowing.

SUMMARY OF THE INVENTION

The object of the invention is to further develop a paint-spraying apparatus for producing a shaped paint jet, wherein the paint-spraying apparatus is suitable for dispensing the shaped paint jet (with unchanged alignment of the paint-spraying apparatus in space) in a different orientation.

The invention relates to a paint-spraying apparatus in which the paint outlet opening is rotatable together with the needle head about the longitudinal axis of the needle in order to rotate the orientation of the shaped paint jet with respect to the longitudinal axis. It is thus possible to rotate the shaped paint jet (with unchanged alignment of the paint-spraying apparatus) about its own axis. For example, a shaped paint jet initially formed as a horizontally arranged bar can thus be used in order to then spray a vertically aligned wall face by means of a shaped paint jet formed as a vertically running bar whilst avoiding spraying an area to be kept free from paint. A rotational adjustability of this type of the shaped paint jet allows the user, in particular when working in edge regions, to maintain a relaxed position or to become accustomed to comfortable motion sequences. Furthermore, the user does not have to apply any torsional force in order to rotate about the longitudinal axis the paint-spraying apparatus, which is formed as a paint-spraying gun or paint-spraying or paint-atomizing lance and has an eccentric weight distribution, in particular caused by a paint container and/or feed lines.

The core of the invention is therefore a division into two of the paint-spraying apparatus into a main unit grasped by the user by one or both hands and a dispensing unit coupled rotatably to the main body, wherein the dispensing unit is rotatable with respect to the main unit, such that a continuous spraying process is ensured.

The embodiment, which is considered to be completely novel and previously unconventional compared to the prior art, of forming components of the paint-carrying portions of a paint-spraying apparatus so as to be rotatable about a longitudinal axis and, in doing so, of providing an ensured function without clogging with paint or restriction of the functional scope will be described in greater detail in the following exemplary embodiments. Here, the exemplary embodiments describe individual features of the invention, of the dependent claims, or groups thereof. The dependent claims however are not to be considered as being linked in accordance with the exemplary embodiment. Rather, they form individual building blocks having individual expedient features, which are implemented and presented fully or at least partly in the exemplary embodiment.

BRIEF DESCRIPTION OF THE DRAWINGS

For a more detailed explanation, the following are shown in the figures.

DETAILED DESCRIPTION OF THE INVENTION

Figure 1:
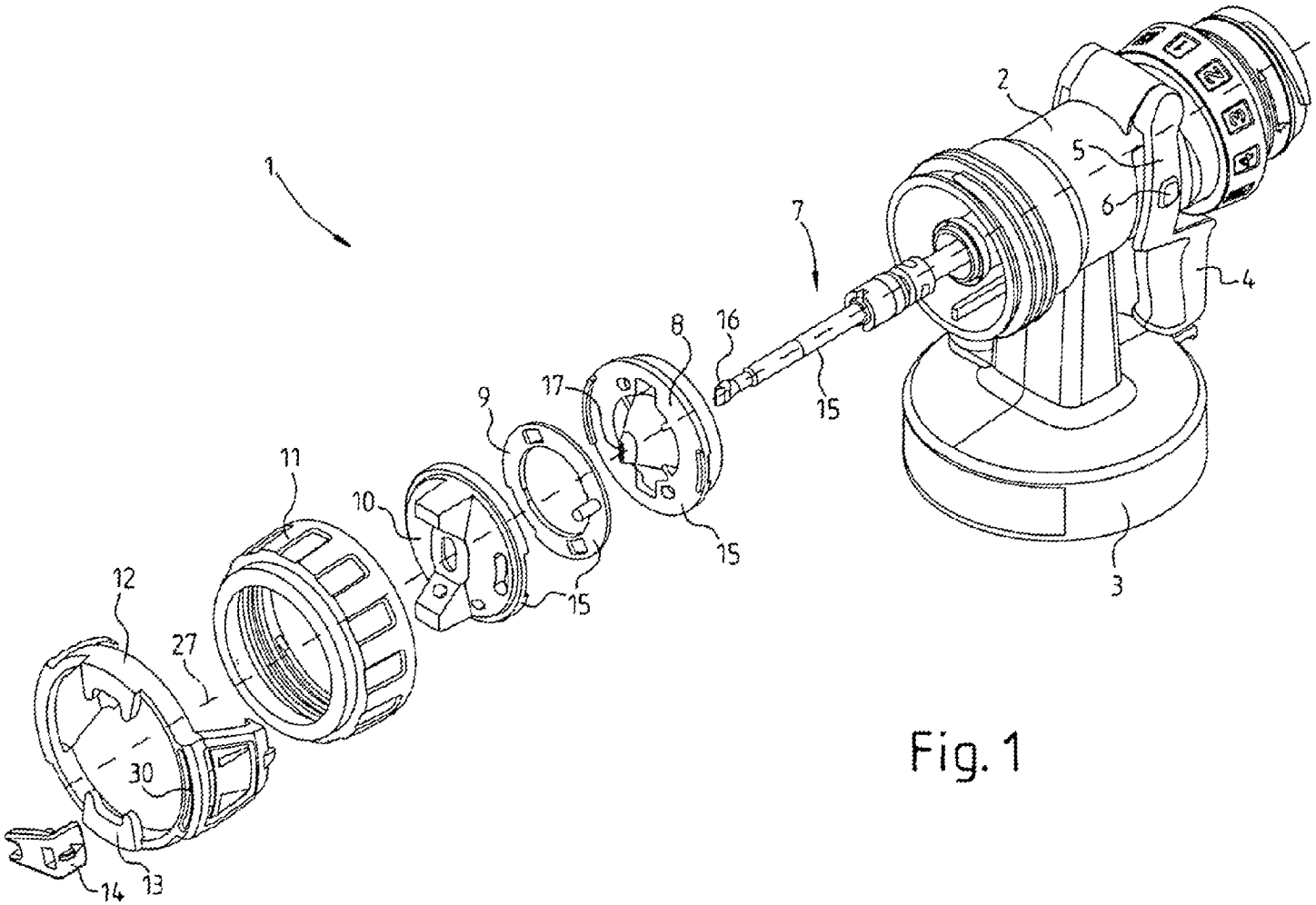
FIG. 1 a first exploded illustration of a paint-spraying apparatus according to the invention.

More specifically, FIG. 1 shows an exploded illustration of a paint-spraying apparatus 1. The paint-spraying apparatus is formed in the base by a body 2, at the lower end of which a receptacle 3 for a paint container is provided. An alternative embodiment (not illustrated) is conceivable, in which the receptacle 3 for the paint container is omitted and a paint feed line feeds the paint to the body 2 from a remote container. This is described for example in German patent application DE 10 2009 048 022 A1, in the name of the applicant.

The body 2 has a trigger 4, which is fixed in an oscillating manner to the body 2 on an upper side and entrains a coupling pin (illustrated in FIG. 4) via a blind hole arranged laterally in the trigger lever 5 or a bore (covered here by the covering cap 6). This coupling pin is used, as is known in general from the prior art, to press a needle 7 back against a spring weight or the like in order to operate a needle valve for controlling an outlet of paint.

The paint-spraying apparatus 1 according to the invention, besides the body 2 and the needle 7, comprises an air link 8, a control disk 9, an air cap 10, a cap nut 11 and a rotary actuator 12 with drivers 13 arranged thereon and, where necessary, a further driver 14 arranged thereon. The mentioned component parts are arranged in the direction of air flow, starting from the body 2, in the manner illustrated in FIG. 1.

The air cap 10, the control disk 9, the air link 8 and the needle 7 here form a structural unit 15, which provides the technical preconditions for the paint atomizing process. Here, the needle 7 with its needle head 16 engages in a paint outlet opening 17, which is arranged centrally in the air link 8. The wedge shape of the needle head 16 is adapted here to the shape of the paint outlet opening 17 in such a way that it closes the opening in a paint-tight manner as a result of engagement in the fully inserted position. The technical principles of a needle valve, which provides an opening gap in a paint outlet opening 17 by pulling back the needle, wherein paint can then exit through the opening gap in a metered manner, are known a number of times from the prior art for rotationally symmetrical needles and paint outlet openings.

Figure 2:
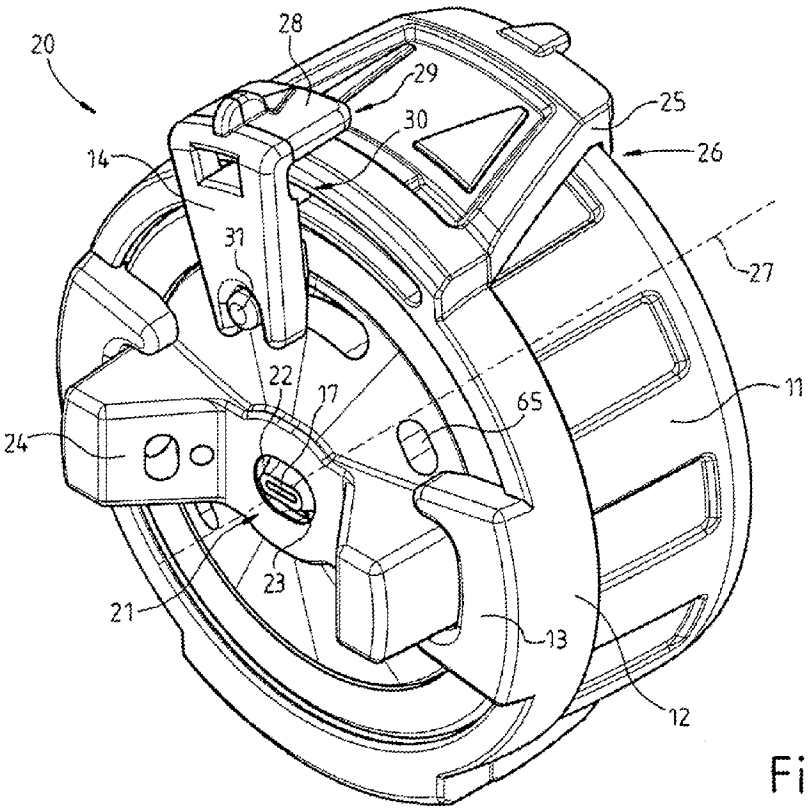
FIG. 2 an assembled paint-spraying head.

FIG. 2 shows an assembled embodiment of a spray head 20 of a paint-spraying apparatus according to the invention. The spray head 20 is formed here by the air link 8, the control disk 9 arranged thereon, the air cap 10 covering the control disk, the cap nut 11 arranged thereover and also the rotary actuator 12 clipped thereonto and the further driver 14. The needle 7 starting from the body 2 is not illustrated in the present case.

A paint nozzle 21 is formed on the paint outlet side of the spray head 20 by the paint outlet opening 17 and the needle 7 (not illustrated). The paint nozzle 21, which is slot-shaped in the present case, is arranged inside an atomizer air opening 22 in the air cap 10. The edge of the atomizer air opening 22 and also the edge of the paint outlet opening 17 define the annular gap 23 which surrounds the paint nozzle 21 and through which the atomizer air for atomizing the paint exiting from the paint outlet opening 17 flows. A paint mist is thus produced by known atomizing principles.

In the continuation of the longitudinal axis of the slot-shaped paint outlet opening 17, air horns 24 are arranged in such a way that they direct a directed shaping air jet onto the paint mist exiting from the paint outlet opening 17 and the annular gap 23 and thus further intensify the formation of a flat jet. This principle is likewise known from the prior art in the name of the applicant mentioned in the introduction.

The rotary actuator 12 is clipped via lateral clamping wings 25 onto the cap nut 11 and, as a result of the form fit 26, engaging from behind, of the clamping wings 25, is thus arranged rotatably on the cap nut 11 along a longitudinal axis 27. The rotary actuator 12 comprises drivers 13, which are arranged in accordance with the air horns 24 and which, by wrapping around the air horns in a form-fitting manner, ensure that the air horns are also driven as the rotary actuator 12 is rotated. Furthermore, the rotary actuator 12 has a saddle guide 30 in which the further driver 14 is guided, wherein the further driver 14 is in turn secured to the rotary actuator 12 via a clamping wing 28 and a form-fitting engagement from behind 29, in such a way that it is displaceable along the saddle guide 30 over a circular path about the longitudinal axis 27. The further driver 14 here operates a pin 31, which is arranged on the control disk 9. The control disk 9, arranged behind the air cap 10, can thus be rotated by the further driver 14.

Figure 3:
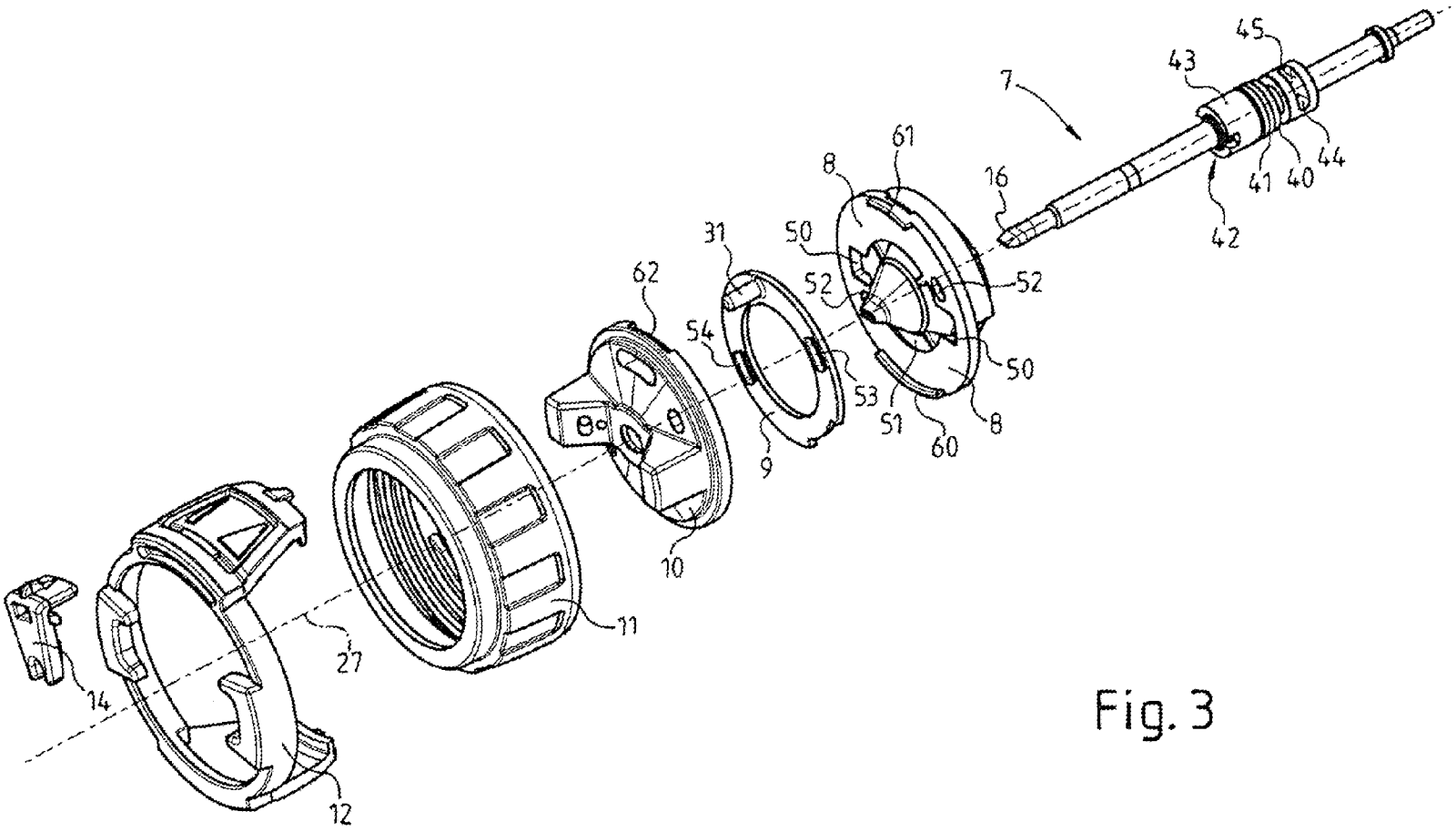
FIG. 3 a second exploded illustration of a paint-spraying head with needle.

In FIG. 3, the exploded illustration illustrated in accordance with FIG. 1 is shown, wherein the gun body 2 is not illustrated and the arrangement of the individual component parts has been rotated through 90° in a clockwise direction as considered in the air flow.

The needle 7 on its side facing away in the needle head 16 has a seal arrangement. The seal arrangement comprises a contact surface 40, in front of which at least one seal 41 (in the present case two seals are provided) is arranged. The seal or the seals 41 is/are held by a thread 42 arranged on the needle 7 via a clamping nut 43 screwed thereonto and can be adjusted in terms of their sealing effect by corresponding pre-stressing of the clamping nut 43.

In the rearward direction, the needle 7 then follows a seal arrangement of the passage 44 for the coupling pin (illustrated in FIG. 4), which comprises the pressure surfaces 45 for the force transmission for pulling back the needle 7.

The passage 44 is formed as a substantially quadrangle-shaped passage 44, wherein this passage 44 is likewise provided symmetrically about the longitudinal axis 27 on the other side of the needle (not illustrated here). Due to the substantially quadrangle-shaped design of the passage 44, it is made possible for the needle to be rotatable through an angle of approximately 90° in accordance with the passage opening 44 without resulting in any torsion effects on the needle 7 by the coupling pin passing through the needle.

Figure 5:
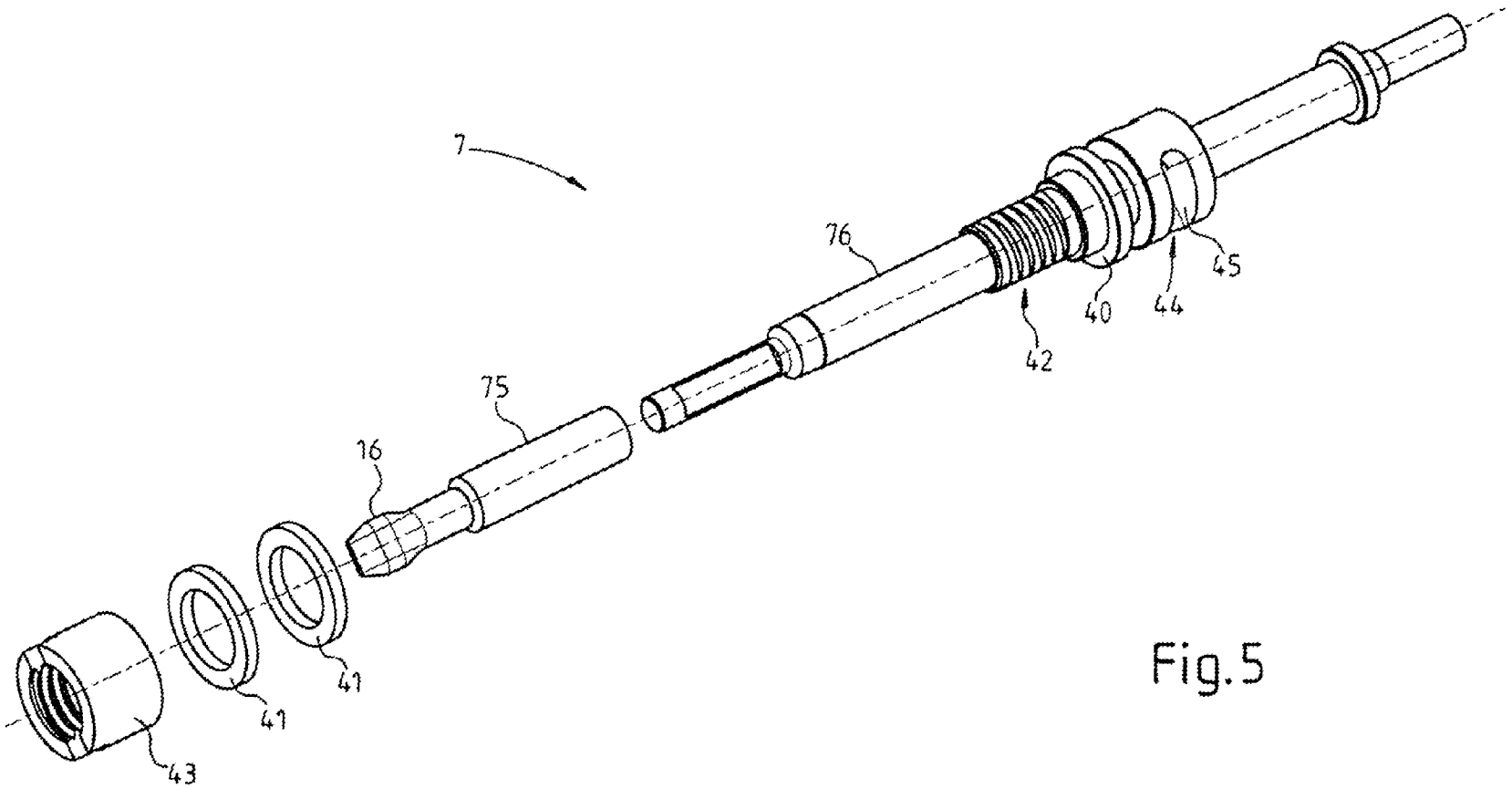
FIG. 5 a needle according to the invention for the paint-spraying apparatus.

Besides the arrangement of the pressure surface 45 and the seal, which will be described in greater detail in subsequent FIG. 5, FIG. 3 shows the arrangement of the passage openings for the individual air guides. Besides the passage opening for the atomizer air 51, which subsequently passes through the annular gap 23 described in FIG. 2, the air link 8 comprises openings for the horn air 50 and also openings for the compensating air 52. The control disk 9 comprises two control openings 53 and 54, which, as the control disk 9 is rotated about the longitudinal axis 27, can be brought into line either with the openings for the horn air 50 or the openings for the compensating air 52. Corresponding air channels for the horn air 50 and the compensating air 52 are also provided in the air cap 10.

The control disk 9 is slightly smaller in diameter compared to the diameter of the air link 8. The air link 8 on its surface facing the control disk 9 has springs 60 and 61, between which the control disk 9 is inserted and is guided in the event of rotation about the longitudinal axis 27. At least one of the springs 60, 61 still protrudes here in the assembled state beyond the control disk 9, such that, for defined arrangement and rotational positional fixing of the air cap 10, it engages in a groove 62 arranged in the air cap 10 on the contact side to the air link 8 and the control disk 9.

The technical function of the described air paths, which can be changed over, between an air passage through the air horns 24 and an air passage through the compensating bores 65 (see FIG. 2) lies in the avoidance of a rise of the internal air pressure in the paint-spraying apparatus. Since, in the apparatuses, fans are usually used to provide the working air and use a specific volume flow rate for their own cooling, it is disadvantageous to reduce the volume flow rate that can pass through a spray head. As soon as the air horns 24 forming the spray jet are therefore switched off by moving the control disk 9 via the pin 31 in order to influence the dispensed spray jet, a reduced total air volume flow rate would be produced without the compensating bores 65. The fan should be able to cope with this. If the fan is dependent on the volume flow rate for cooling, the corresponding volume has to be discharged through the compensating bores in order to avoid an increased backup and to further cool the fan sufficiently. This technique is described for another type of spray guns in the prior art document EP 0 596 939 B1.

Figure 4:
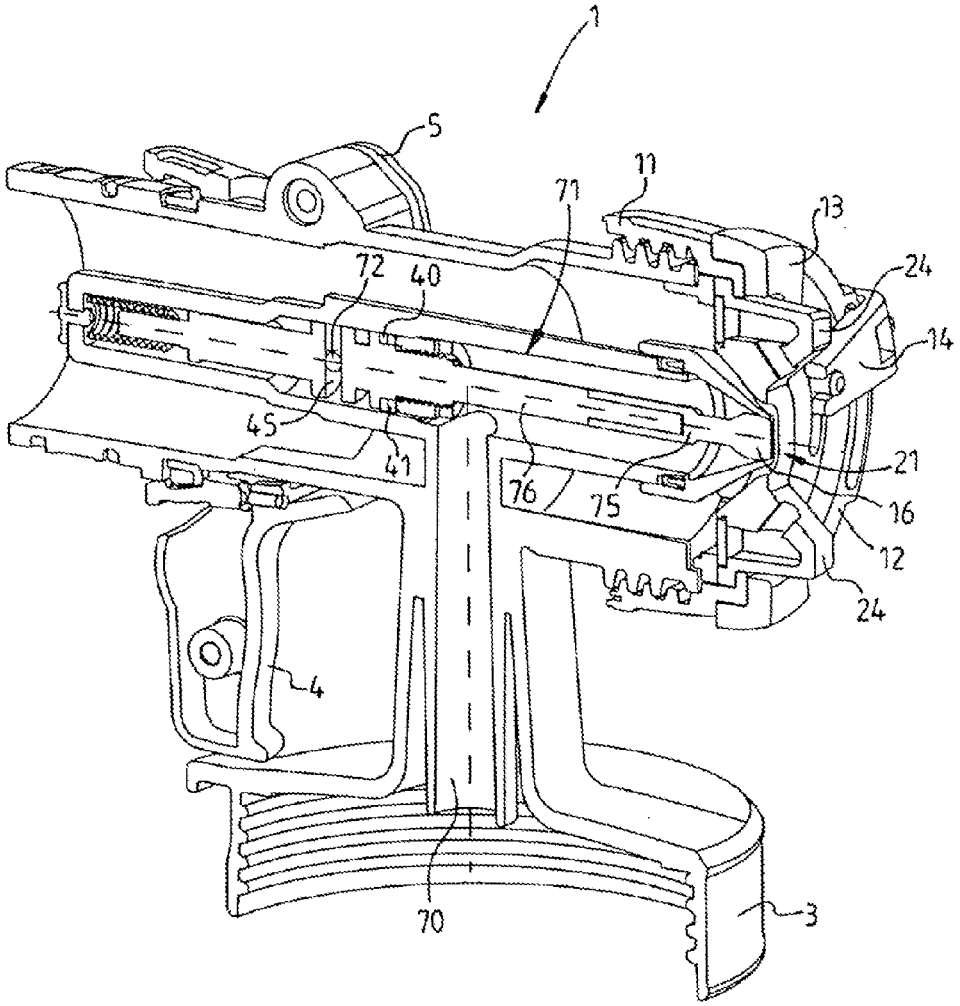
FIG. 4 a cross section through an assembled paint-spraying apparatus.

FIG. 4 shows a cross section through a paint-spraying apparatus 1 according to the invention. The individual component parts are denoted in accordance with the above-described reference signs.

Proceeding from a paint-conveying tube (not illustrated) in a paint container screwed onto the receptacle 3, paint is transported through a riser pipe 70 via the paint chamber 71 to the paint nozzle 21. The paint chamber 71 is formed here substantially as a sleeve receiving the needle 7 completely and having an opening for the coupling pin 72 and also having the access of the riser pipe 70. During operation, only the front part of the paint chamber 71 is filled with paint.

Inside the paint chamber, the needle 7 is arranged displaceably along the longitudinal axis 27 relative to the opening of the paint outlet opening 17. The needle can be provided as a two-part design, for example if a front portion 75 with the needle head 16 is to be produced from a material different from that of a rear portion 76. This is to be provided for example for the formation of the needle head as a closure part, which is to be replaced more frequently compared to the rest of the arrangement. In principle, it is also possible to form a simple rotary joint by means of the parts of the front and rear portion 75, 76 pushed one inside the other in order to mount the needle head 16 rotatably with the paint outlet opening 17. In this case, the above-described semi-circular passage could be omitted. A problem with this rather deteriorated embodiment could be a sticking of the component parts as a result of paint.

In FIG. 5, a needle 7 according to the invention is illustrated in detail. In contrast to conventional feedthroughs known from the prior art of the needle through a seal assembly which is arranged fixedly in the housing and which is costly and of complex design, the seal arrangement in the present case is fixed on the needle 7. Whether the needle is formed here as a two-part embodiment, as presented in the present case, or is present in the form of a one-part needle is insignificant for the seal arrangement and the functionality described hereinafter.

Specifically in the field of professional tools, seal assemblies of which the tension can be adjusted are often of great advantage. The adjustment or readjustment of a seal tension makes it possible to access the optimum trigger pressure point, which is determined by the sliding friction of the needle 7 in the seal, or in the present case by that of the seal 41 in the paint chamber 71.

The adjustability is provided in the present case by the tension that is exerted by means of the clamping nut 43 onto the seal assembly consisting of the two ring seals 41. The clamping nut 43 is to this end screwed on the thread 42 against the seals 41 and presses these against the contact surface 40. Depending on the contact pressure, a sealing bead is produced radially outwardly from the longitudinal axis 27 and brings about the sealing effect with respect to the wall of the paint chamber 71.

Alternatively, it is also possible for a coupling means of the needle trigger 4, 5 to bear against a radial widening or radial constriction of the needle 7 with respect to the longitudinal axis 27 and to thus move this in the manner of a plate driver.

The invention therefore also comprises a paint-spraying apparatus for producing a paint jet with a needle 7 received displaceably in a channel, wherein a paint-carrying portion of the channel is sealed by a seal sheathing the needle, and the seal is fixed in the axial direction relative to the needle.

Here, the seal is fixed between a first stop and a second stop, wherein at least one stop on the needle is preferably adjustable in the axial direction.

For improved guidance of the seal, this is fixed in the peripheral direction relative to the needle, for example by a form-fitting tongue-and-groove rotary fixing or a rough structure on the contact surface 40, for example a toothed lock washer structure.

If the needle 7 is provided in two parts or a number of parts, the front needle portion 75 and the rear needle portion 76 can be rotatable relative to one another about a common longitudinal axis 27. Here, the first material of the front portion 75 is advantageously a plastic material (for example POM material), and the second material of the rear portion 76 is advantageously a metal material (for example a zinc casting). The front portion 75 can be connected here to the rear portion 76 during the production process by insert molding of the rear portion.

It is additionally advantageous for the paint outlet opening 17 to be formed from a third material, which is harder than the material of the front needle portion 75, and for the third material to be in particular ceramic and in particular sintered ceramic.

LIST OF REFERENCE SIGNS

1 paint-spraying apparatus
2 body
3 receptacle
4 trigger
5 trigger lever
6 cover cap
7 needle
8 air link
9 control disk
10 air cap
11 cap nut
12 rotary actuator
13 driver
14 further driver
15 structural unit
16 needle head
17 paint outlet opening
20 spray head
21 paint nozzle
22 atomizer air opening
23 annular gap
24 air horn
25 clamping wing
26 form fit
27 longitudinal axis
28 clamping wing
29 form-fitting engagement from behind
30 saddle guide
40 contact surface

41 seal
42 thread
43 clamping nut
44 passage
45 pressure surface
50 opening for the horn air
51 opening for the atomizer air
52 opening for the compensating air
53 control opening
54 control opening
60 spring
61 spring
62 groove
65 compensating bore
70 riser pipe
71 paint chamber
72 coupling pin
75 front portion
76 rear portion

The invention claimed is:

1. A paint-spraying apparatus for producing a shaped paint jet, comprising a paint nozzle positioned in an annular gap, wherein the paint nozzle comprises a needle with a needle head and a paint outlet opening, wherein the needle head is displaceable with respect to the paint outlet opening over a longitudinal axis of the needle in order to control a needle valve formed from the paint outlet opening and the needle head, wherein the needle head, in a closed position of the paint nozzle, is plugged in a form-fitting manner with respect to the longitudinal axis in the paint outlet opening, and wherein the paint outlet opening is slot shaped and the paint outlet opening is rotatable together with the needle head about the longitudinal axis in order to rotate an orientation of the shaped paint jet with respect to the longitudinal axis with an alignment of a body of the paint-spraying apparatus in space unchanged.

2. The paint-spraying apparatus as claimed in claim 1, wherein the needle is formed as a torsionally rigid needle, wherein the needle is connected to a needle trigger via pressure surfaces arranged on the needle and on the needle trigger, in such a way that the needle can be rotated through at least 90° about the longitudinal axis whilst avoiding a lasting torsional force acting on the needle trigger.

3. The paint-spraying apparatus as claimed in claim 1, wherein a coupling mechanism of a needle trigger passes through a passage in the needle with play.

4. The paint-spraying apparatus as claimed in claim 3, wherein the coupling mechanism is a coupling pin that bears against one of a radial widening and a radial constriction of the needle with respect to the longitudinal axis.

5. The paint-spraying apparatus as claimed in claim 1, wherein the needle comprises a first needle portion, on which the needle head is formed, and at least one second needle portion, which is connected to a needle trigger, wherein the first and second needle portions are rotatable relative to one another with respect to the longitudinal axis, wherein the first needle portion, with adjustment of the shaped paint jet, is rotated together with the paint outlet opening about the longitudinal axis, and wherein the second needle portion, with adjustment of the shaped paint jet, is coupled to the needle trigger in the same rotary position with avoidance of rotation about the longitudinal axis.

6. The paint-spraying apparatus as claimed in claim 1,
wherein the paint-spraying apparatus comprises a spray head having a cap nut and a rotary actuator,
wherein the rotary actuator is mounted rotatably on or beneath the cap nut, by means of which the paint outlet opening is fastened to a body of the paint-spraying apparatus, and
wherein the rotary actuator comprises at least one driver, by means of which the annular gap formed in an air cap and the paint outlet opening formed on an air link are rotated about the longitudinal axis with rotation of the rotary actuator.

7. The paint-spraying apparatus as claimed in claim 6,
wherein the spray head, besides the air link with the paint outlet opening and the air cap with the annular gap, comprises a control disk,
wherein a structural unit consisting of the air cap, the air link, the control disk and the needle is secured to the body of the paint-spraying apparatus, and
wherein the structural unit is rotated about the longitudinal axis by the at least one driver of the rotary actuator.

8. The paint-spraying apparatus as claimed in claim 7, wherein within the structural unit, the component parts formed by the air cap, air link and needle are coupled to one another in terms of a rotation about the longitudinal axis, and wherein the control disk in the structural unit is rotatable with respect to the other component parts of the structural unit.

9. The paint-spraying apparatus as claimed in claim 8, wherein the structural unit is rotatable with respect to the other component parts of the structural unit through an angle of 10° to 45°.

10. The paint-spraying apparatus as claimed in claim 9, wherein the structural unit is rotatable with respect to the other component parts of the structural unit through an angle of approximately 30°.

11. The paint-spraying apparatus as claimed in claim 6,
wherein the rotary actuator comprises a further driver, by means of which the air control disk can be rotated in any rotational position of the rotary actuator with respect to the other component parts of the structural unit,
wherein an air supply of the air cap is adjusted by a relative displacement of the further driver with respect to a saddle guide of the rotary actuator, and
wherein the further driver is coupled in particular in a form-fitting manner to the air control disk.

12. A paint-spraying apparatus for producing a shaped paint jet, comprising
an air link,
a paint nozzle with a paint control valve,
an air cap arranged after the air link in the direction of air flow,
an opening arranged radially symmetrically in the air link for the passage of a paint outlet opening,
an opening arranged centrally in the air cap for the passage of the shaped paint jet or the paint nozzle and an atomizer air flow surrounding the shaped paint jet or the paint nozzle,
at least one further air opening spaced radially from the opening in the air link,
at least one air-deflecting mechanism, which is arranged on an air opening associated therewith in the air cap and deflects a passing air jet in the direction of the paint jet or the paint/air jet,
wherein the air opening in the air cap and an air opening in the air link have a comparable radial distance from the midpoint of the air cap and the air link respectively,
wherein the central opening in the air cap is formed as a slot-shaped air cap opening with a first longitudinal axis of the air cap opening and a first transverse axis of the air cap opening, said transverse axis being shorter than the longitudinal axis, wherein a spray head comprises a cap nut and a rotary actuator, wherein the rotary actuator is mounted rotatably on the cap nut, by means of which a structural unit consisting of the air cap, the air link, the paint nozzle and an air control disk is secured to a paint-spraying gun or to a paint-atomizing lance, wherein the rotary actuator comprises at least one driver, by means of which the structural unit is rotated with rotation of the rotary actuator about a longitudinal axis, and wherein the rotary actuator comprises a further driver, by means of which the air control disk is rotated with respect to the other component parts in any position of the structural unit with rotation of the driver about the longitudinal axis, wherein an air supply of the air cap is adjusted by a relative displacement of the further driver with respect to a saddle guide of the rotary actuator.

13. The paint-spraying apparatus as claimed in claim 12, wherein the air-deflecting mechanism is an air horn.

14. The paint-spraying apparatus as claimed in claim 12, wherein a needle is provided with a needle head, wherein the needle head is displaceable in a paint chamber with respect to the paint outlet opening over a longitudinal axis of the needle in order to control the paint control valve formed from the paint outlet opening and the needle head, and wherein a paint-carrying portion of the paint chamber is sealed by a seal sheathing the needle, wherein the seal is fixed in the axial direction relative to the needle.

15. The paint-spraying apparatus as claimed in claim 14, wherein the needle is formed as a two-part needle with a front portion and a rear portion and also a wedge-shaped needle head.

* * * * *